US009915421B2

(12) United States Patent
Liu et al.

(10) Patent No.: US 9,915,421 B2
(45) Date of Patent: Mar. 13, 2018

(54) SATURATED WATER EXPLOSIVE DEVICE

(71) Applicant: Taizhou Dajiang Ind. Co., Ltd., Wenling, Zhejiang Province (CN)

(72) Inventors: Gui-Wen Liu, Wenling (CN); Ming-Jun Yang, Wenling (CN); Jin-Quan Huang, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 276 days.

(21) Appl. No.: 14/588,845

(22) Filed: Jan. 2, 2015

(65) Prior Publication Data

US 2015/0198327 A1 Jul. 16, 2015

(30) Foreign Application Priority Data

Jan. 10, 2014 (CN) ..... 2014 1 0011969

(51) Int. Cl.

| | |
|---|---|
| ***F22B 27/04*** | (2006.01) |
| ***F22B 1/22*** | (2006.01) |
| ***F22G 3/00*** | (2006.01) |

(52) U.S. Cl.

CPC ..... *F22B 27/04* (2013.01); *F22B 1/22* (2013.01); *F22G 3/006* (2013.01)

(58) Field of Classification Search

CPC .. F22B 27/04; F22B 1/22; F22B 1/028; F22G 3/006; B25C 1/041; F24H 9/0021; F24H 9/0015; F24H 1/32; F24H 1/406

(Continued)

(56) References Cited

U.S. PATENT DOCUMENTS 3,119,004 A * 1/1964 Hoop ..... F22B 1/288 122/242

4,352,252 A 10/1982 Brenot (Continued)

FOREIGN PATENT DOCUMENTS

CA 2223457 C 12/1996
CN 2397425 Y 9/2000

(Continued)

OTHER PUBLICATIONS

International Search Report issued by the State Intellectual Property Office of the Peoples Republic of China dated Apr. 1, 2015 for PCT/CN2014/095786.

*Primary Examiner* — Steven B McAllister
*Assistant Examiner* — Steven Anderson, II
(74) *Attorney, Agent, or Firm* — Tim Tingkang Xia, Esq.; Locke Lord LLP

(57) ABSTRACT

The present invention discloses a saturated water explosive device, including a water intake pipe, a flow splitter for splitting a high-pressure liquid, a flow baffle for baffling the high-pressure liquid, a heat receiver having a cavity defined inside, a pillar connected with the heat receiver by a micro-channel wherein the high-pressure liquid is heated to be high-temperature saturated water, and a heat source for heating the cavity. High-pressure water is heated to produce high-temperature high-pressure saturated water, and then by using the saturated water explosive device of the present invention, the produced high-temperature high-pressure saturated water instantaneously explodes as being heated, and a high-temperature high-pressure steam flow is produced due to rapid vaporization, and expansion and is used as a power source.

11 Claims, 5 Drawing Sheets

(58) Field of Classification Search
USPC ..... 122/39, 40, 242, 479.7
See application file for complete search history.

(56) References Cited

U.S. PATENT DOCUMENTS

| | | | | |
|---|---|---|---|---|
| 5,279,262 | A | 1/1994 | Muehleck | |
| 5,419,306 | A | 5/1995 | Huffman | |
| 5,671,700 | A | 9/1997 | Lackstrom | |
| 5,989,437 | A | 11/1999 | Eriksson et al. | |
| 8,495,973 | B2 | 7/2013 | Poshusta et al. | |
| 8,528,649 | B2 | 9/2013 | Kolle | |
| 2003/0230567 | A1 | 12/2003 | Centanni et al. | |
| 2004/0221583 | A1 | 11/2004 | Wylie | |
| 2007/0151451 | A1* | 7/2007 | Rekers | B01D 53/002 95/141 |
| 2009/0294111 | A1* | 12/2009 | Larouche | F28D 1/05366 165/173 |
| 2011/0083619 | A1 | 4/2011 | Master et al. | |
| 2013/0270352 | A1 | 10/2013 | Roth et al. | |
| 2013/0302021 | A1* | 11/2013 | Furumura | F22B 1/28 392/491 |
| 2016/0216045 | A1* | 7/2016 | Chan | F28F 13/12 |

FOREIGN PATENT DOCUMENTS

| | | | |
|---|---|---|---|
| CN | 201382398 | Y | 1/2010 |
| CN | 201629696 | U | 11/2010 |
| CN | 202250373 | U | 5/2012 |
| CN | 102803724 | A | 11/2012 |
| CN | 102865568 | A | 1/2013 |
| CN | 201382398 | * | 1/2013 |
| CN | 204026627 | U | 12/2014 |
| CN | 204026628 | U | 12/2014 |
| CN | 204026634 | U | 12/2014 |
| JP | 2007071419 | A | 3/2007 |
| WO | WO2009060487 | * | 5/2009 |

* cited by examiner

SATURATED WATER EXPLOSIVE DEVICE

CROSS-REFERENCE TO RELATED APPLICATION

This application claims priority to Chinese Patent Application No. 201410011969.9, filed Jan. 10, 2014 in the State Intellectual Property Office of P.R. China, which is hereby incorporated herein in its entirety by reference.

FIELD OF THE INVENTION

The present invention relates to generally to steam power, and more particularly to a saturated water explosive device.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

As to engines, traditional gasoline engines and diesel engines produce harmful exhaust gas, and approximately 50% of the fuel is converted to heat during combustion that overheats the engines. When such engines are applied to crankshafts, camshafts and valves, there are high technical requirements to the engines, which results in problems such as greater costs, and increase of abrasion and weight. Therefore, current trend is to mount a power supply device which converts heat energy of water vapor into mechanical power on an engine, so as to manufacture a piston steam engine and a turbine engine. The piston steam engine has been weeded out gradually due to low conversion efficiency and heavy pollution to the environment, while the turbine engine is widely used in thermal power plants. However, there has been no method or device using high-temperature high-pressure steam flow produced by saturated water explosion as the power source.

Therefore, a heretofore unaddressed need exists in the art to address the aforementioned deficiencies and inadequacies.

SUMMARY OF THE INVENTION

One of the objectives of the present invention is to provide a a saturated water explosive device, which can generate power when high-temperature saturated water instantaneously expands and explodes as being heated.

On aspect of the present invention relates to a saturated water explosive device, including a water intake pipe, a flow splitter for splitting a high-pressure liquid, a flow baffle for baffling the high-pressure liquid, a heat receiver having a cavity defined inside, a pillar connected with the heat receiver by a micro-channel wherein the high-pressure liquid is heated to be high-temperature saturated water, and a heat source for heating the cavity.

In another aspect, the present invention relates to a steam power generation method using a saturated water explosive device, including the steps of: producing a high-temperature saturated water by using a high-pressure liquid including splitting a high-pressure liquid by a flow splitter, baffling the high-pressure liquid by a flow baffle, injecting the high-pressure liquid into a micro-channel connecting a pillar and a heat receiver, and heating the micro-channel to produce the high-temperature saturated water; ejecting the high-temperature saturated water under a high pressure to form tiny saturated water particles; hitting the tiny saturated water particles against the saturated water explosive device at a high temperature; and incurring water explosion to form a high-temperature high-pressure steam flow.

In another aspect, the present invention relates to a steam power generation system, including a saturated water generation device and a saturated water explosive device, comprising a water intake pipe, a flow splitter for splitting a high-pressure liquid, a flow baffle for baffling the high-pressure liquid, a heat receiver having a cavity defined inside, a pillar connected with the heat receiver by a micro-channel wherein the high-pressure liquid is heated to be high-temperature saturated water, and a heat source for heating the cavity.

In one embodiment, the micro-channel of the saturated water explosive device includes a gap defined between the outer surface of the pillar and inner surface of the heat receiver, and the width of the gap is less than 1 mm.

In one embodiment, the micro-channel of the saturated water explosive device includes multiple tiny slots defined on the outer surface of the pillar, and the width of the tiny slot is less than 1 mm and the depth thereof is less than 1 mm.

In one embodiment, the micro-channel of the saturated water explosive device includes both the gap and the tiny slots.

In one embodiment, the cavity of the saturated water explosive device includes is provided with a porous material.

In certain embodiments, the porous material has a mesh structure.

In certain embodiments, one side of the porous material is a saturated water inlet, and the other side is a steam outlet.

In certain embodiments, the porous material is for increasing the heating area of saturated water.

In one embodiment, the saturated water explosive device may comprise a heat conductor embedded in the pillar, so that the heat energy can be immediately replenished after the temperature of the pillar decreases.

In one embodiment, the saturated water explosive device may further comprise a heat conductor independently located outside the pillar.

High-pressure water is heated to produce a high-temperature high-pressure saturated water, and then by using the saturated water explosive device of the present invention, the produced high-temperature high-pressure saturated water instantaneously explodes as it is heated, and a high-temperature high-pressure steam flow is produced due to rapid vaporization and expansion, which is used as a power source. Such power source generated by the foregoing manner has more advantages over the existing internal combustion engine using fuel oil:

1. Requirements of fuel types and quality are not strict, as long as a qualified heat source at a temperature of 400° C. is provided; and the thermal conversion efficiency is high.

Experiments show that the thermal conversion efficiency can reach 25% to 35%, which is about 20% higher than that of the existing internal combustion engine.

2. The range of engines to which the device of the present invention can applies is extended. In comparison with the internal combustion engine using fuel oil, the device has greatly reduced exhaust noise, better torque characteristics, can even perform stepless speed change in a car without a gearbox during power output in traveling, and can exhaust gas with less harmful ingredients.

3. The device of the present invention has a simple structure, light and small, and flexible to move.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
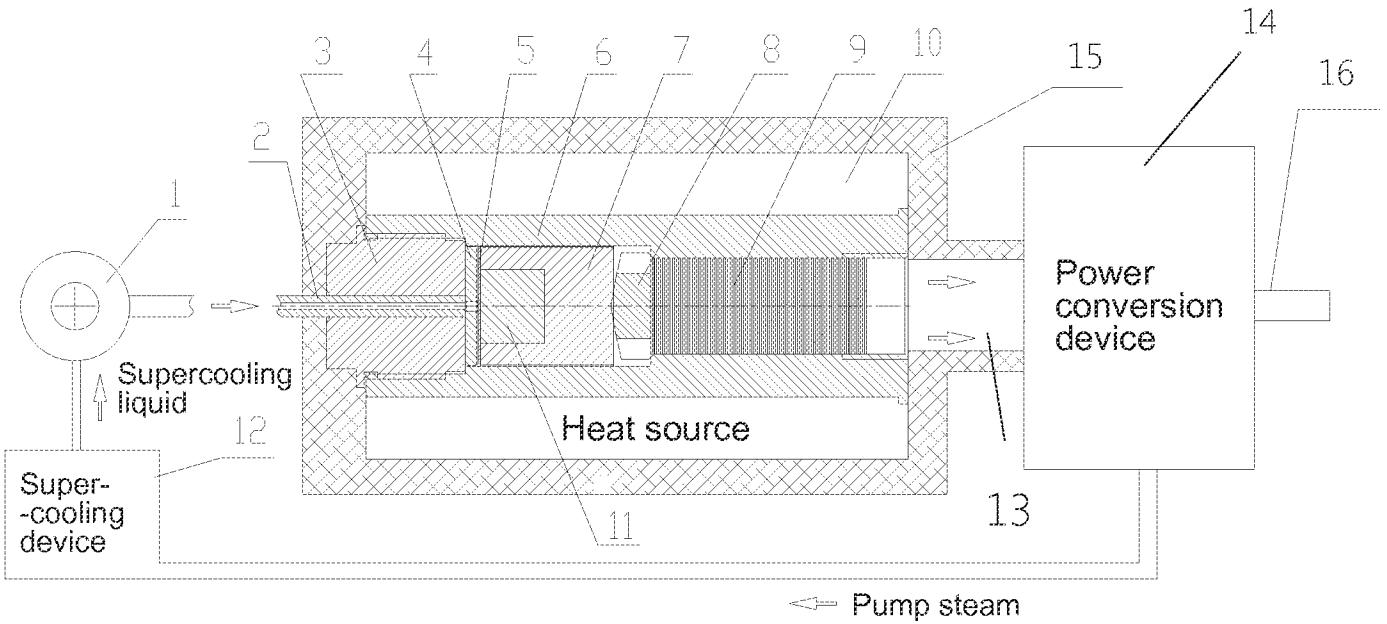
FIG. 1 is a schematic structural diagram of a steam power generation system according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the invention in conjunction with the accompanying drawings in FIGS. 1-5. In accordance with the purposes of this invention, as embodied and broadly described herein, this invention, in one aspect, relates to a steam power generation system, including a saturated water generation device and a saturated water explosive device.

In one embodiment, as shown in FIG. 1, the system includes a water intake thin pipe 2, a plug screw 3, a flow splitter 4, a flow baffle 5, a heat receiver 6, a pillar 7, a base 8, a heat source 10, and a heat conductor 11.

The water intake thin pipe 2 is embedded in the plug screw 3 along with a central axis of the plug screw 3. The plug screw 3 is connected to the heat receiver 6 through threads, and exerts a pre-tension force on the flow splitter 4 and flow baffle 5. The other side of the flow baffle 5 is connected with pillar 7 and heat conductor 11.

The heat conductor 11 is embedded in pillar 7, and may also be adhered to the outside of pillar 7.

The surface of the other end of pillar 7 is connected with base 8, and base 8 is in contact with a ledge on the inner wall of the heat receiver 6 to support the heat receiver 6.

Outer side of the heat receiver 6 is provided with a heat source 10.

Figures 2A, 2B:
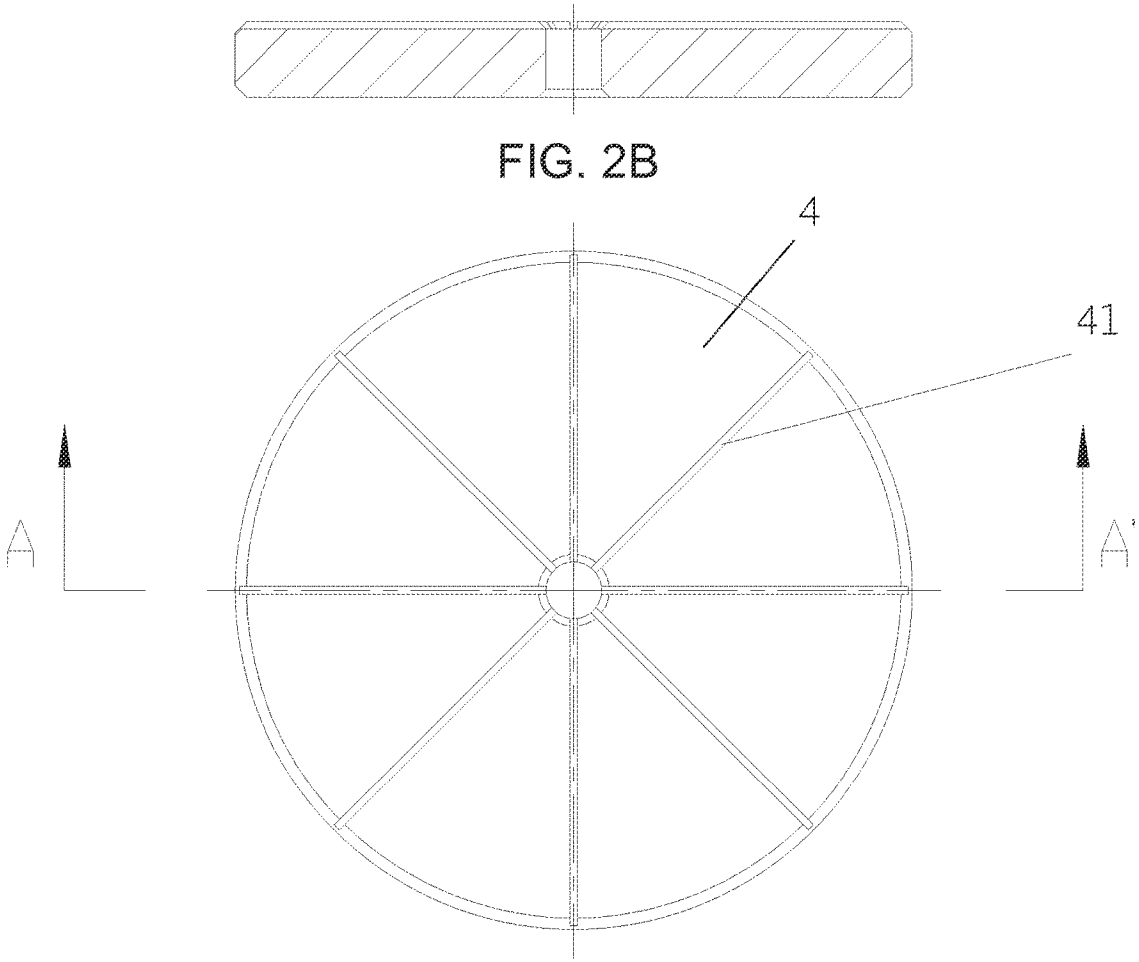
FIG. 2A is a schematic structural diagram of a flow splitter in a saturated water generation device.
FIG. 2B is a cross sectional view of a flow splitter along A-A' of FIG. 2A.
Figure 3:
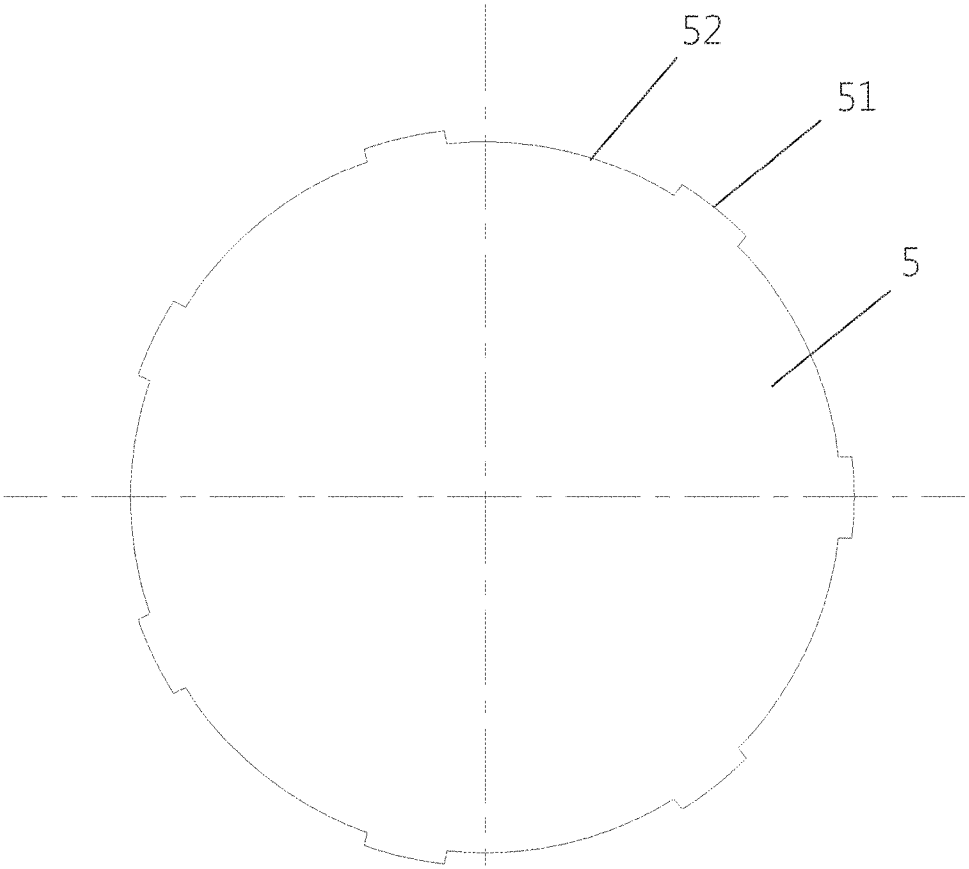
FIG. 3 is a schematic structural diagram of a flow baffle in the saturated water generation device.

In one embodiment, as shown in FIG. 2 and FIG. 3, multiple liquid through slots 41 are radially defined on the flow splitter 4 from a center of the flow splitter 4 to a periphery of the flow splitter 4 so that each of the multiple through slots 41 is perpendicular to the water intake pipe 2, which is shown together in FIG. 1 and FIG. 2, and high-pressure liquid enters the liquid through slots 41 from the water intake thin pipe 2. As such, a flow path of the high-pressure liquid in each of the multiple through slots 41 is perpendicular to that in the water intake thin pipe 2.

The flow baffle 5 is in contact with flow splitter 4, and multiple protrusions 51 are disposed and recesses 52 are defined on the periphery of the flow baffle 5.

Outer edges of the protrusions 51 press against the inner wall of the heat receiver 6, and the liquid in the liquid through slots 41 can enter one side of the pillar 7 through the recesses 52.

In certain embodiments, micro-channel is provided between pillar 7 and heat receiver 6, in which high-pressure liquid is heated to be high-temperature saturated water.

In certain embodiments, the micro-channel includes a gap 71 defined between the outer surface of the pillar 7 and inner surface of the heat receiver 6, and the width of the gap is less than 1 mm.

In certain embodiments, the micro-channel includes multiple tiny slots 72 defined on the outer surface of the pillar 7, and the width of the tiny slot is less than 1 mm and the depth thereof is less than 1 mm.

In certain embodiments, the micro-channel may also include both the gap 71 and the tiny slots 72. And repeated experiments have shown that the system has the best steam production effect when the micro-channel includes both the gap 71 and the tiny slots 72 and the width of the gap 71 is less than 1 mm.

The high-pressure liquid enters the water intake thin pipe 2 through a liquid pump 1, split by the flow splitter 4 and baffled by the flow baffle 5, and then enters the micro-channel. Then it is heated in the narrow space of the micro-channel, to produce high-temperature high-pressure saturated water. The high-temperature high-pressure saturated water is ejected under a high pressure to form tiny saturated water particles. The tiny saturated water particles hit against the saturated water explosive device at a high temperature to incur water explosion, and high-temperature high-pressure steam is produced through rapid and intense vaporization.

In one embodiment, the saturated water explosive device includes a porous material 9. The porous material 9 is placed in a cavity defined in the heat receiver 6 and is close to an end of a steam outlet 13.

In one embodiment, the porous material 9 may have a mesh structure.

The outer side of the steam outlet 13 is connected with a power conversion device 14, which may be a cylinder or a turbine working outward to output power through a power output shaft 16.

In one embodiment, the heat source 10 is provided outside of the heat receiver 6. The heat source 10 may provide heat energy generated by fuel combustion, or waste-heat energy at an appropriate temperature, or heat energy accumulated by a phase-change heat accumulator, etc. In certain embodiments, the heat source may be coated with a heat insulating layer 15. The plug screw 3 is connected to the heat receiver 6 through threads, and exerts a pre-tension force on the flow splitter 4 and the flow baffle 5. An end surface of the plug screw 3 is tightly sealed to the heat receiver 6. The flow splitter 4 is for splitting radial flow and preheating.

Figure 4A:
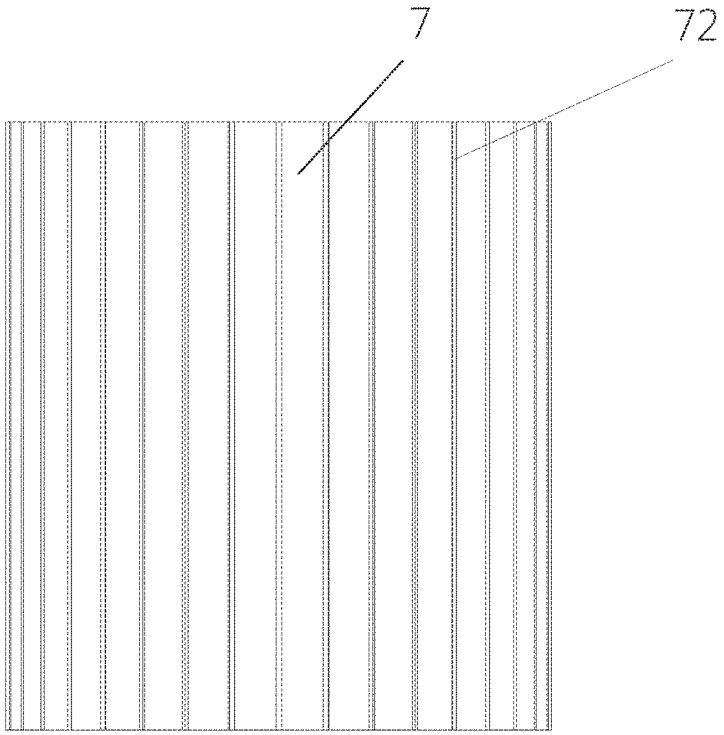
FIG. 4A is a side view of a pillar in the saturated water generation device.
Figure 4B:
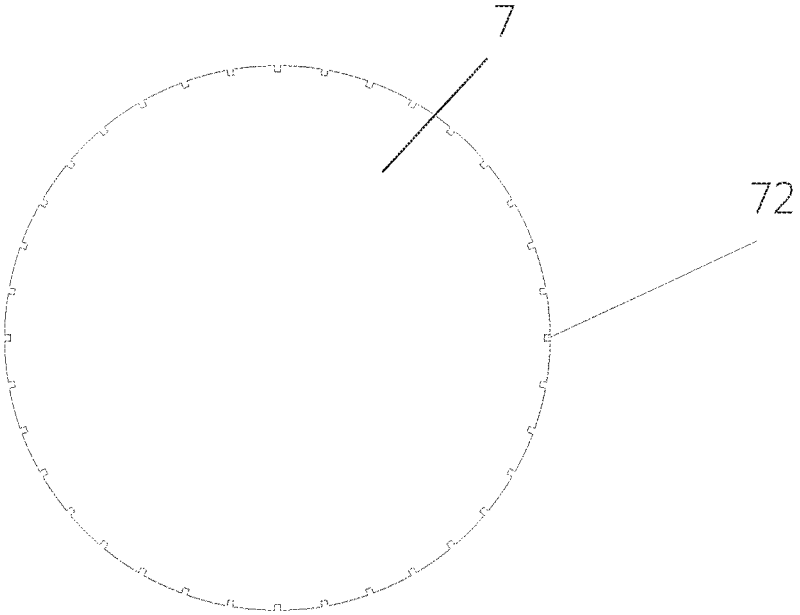
FIG. 4B is a top view of a pillar in the saturated water generation device.
Figure 5:
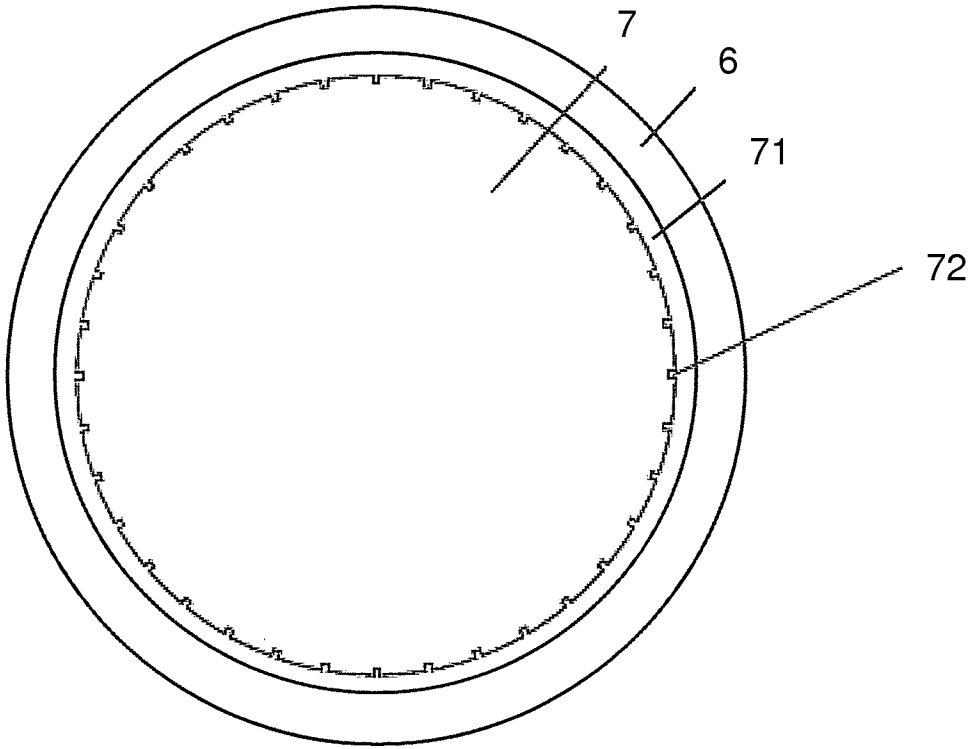
FIG. 5 is a schematic assembled structural diagram of the pillar and the heat receiver in the saturated water generation device.

Pillar 7 and heat conductor 11 are adjacent to flow baffle 5. Pillar 7 is a solid or porous sintered material, which is a heat-proof steel material that endures high temperature and corrosion. Several or dozens of tiny slots are radially or axially defined on the outer surface of pillar 7, as shown in FIGS. 4A and 4B.

In certain embodiments, heat conductor 11 may be embedded in pillar 7, or independently located outside pillar 7, made from a heat-conducting, enduring high temperature and corrosion high-performance material. Because one end of pillar 7 that is close to the flow baffle 5 first contacts the high-pressure liquid, heat energy is rapidly absorbed by the high-temperature liquid to cause the temperature of the pillar 7 to decrease. Therefore, the heat conductor 11 is disposed so as to strengthen heat conduction, so that the heat energy can be immediately replenished after the temperature of the pillar 7 decreases. In this way, steam power generated by a pulse is even and stable each time. Base 8 contacts a ledge on the inner wall of the heat receiver 6 to support the heat receiver 6. The porous material 9 is made from a good-quality, heat-proof, high temperature enduring oxidation material.

In certain embodiments, a supercooling device 12 is further provided in front of the high-temperature liquid inlet, and the supercooling device 12 is connected to the power conversion device 14, thereby recycling the liquid.

In another aspect, the present invention relates to a steam power generation method, including the following steps:

1) producing a high-temperature saturated water by using a high-pressure liquid; and 2) instantaneous heating the high-temperature saturated water to explode, to form a high-temperature high-pressure steam flow.

The water vaporization process is well-known. For example, 1 kg water at 0° C. is loaded in a container with a piston, and the container is heated from the outside. The pressure inside the container is kept unchanged at p. At the beginning, the temperature of the water rises, and the specific volume also increases slightly. When the temperature rises to the saturation temperature $t_s$ corresponding to p, water changes into saturated water. If the container is continuously heated, the saturated water changes into saturated water steam gradually, that is, vaporizes till the end. During the whole vaporization process, the temperature is kept unchanged at the saturation temperature $t_s$. During the vaporization process, the specific volume is greatly increased as the amount of the saturated water steam increasingly grows. If the container is continuously heated, the temperature rises again and the specific volume keeps increasing, and then the saturated water steam changes into superheated water steam.

When the water contacts a high-temperature object and exploses, because the saturated water is in a high-temperature saturated state (the critical pressure $p_c$ is 22.064 MPa, and the critical temperature $t_c$ is 373.99° C.) and has a stronger vaporization capability than unsaturated water, the saturated water absorbs less heat, but vaporizes more rapidly, and can produce a high-temperature high-pressure steam flow when instantaneously explodes. However, the steam does not explode when contacting a high-temperature object, and only expands when heated.

The foregoing description of the exemplary embodiments of the invention has been presented only for the purposes of illustration and description and is not intended to be exhaustive or to limit the invention to the precise forms disclosed. Many modifications and variations are possible in light of the above teaching. Although not explicitly described in the present invention, other embodiments within the scope of the invention and defined by the claims may be obtained by combining, modifying or changing the exemplary embodiments as described in the present invention.

The exemplary embodiments were chosen and described in order to explain the principles of the invention and their practical application so as to activate others skilled in the art to utilize the invention and various exemplary embodiments and with various modifications as are suited to the particular use contemplated. Alternative embodiments will become apparent to those skilled in the art to which the invention pertains without departing from its spirit and scope.

Accordingly, the scope of the invention is defined by the appended claims rather than the foregoing description and the exemplary embodiments described therein.

What is claimed is:

1. A saturated water explosive device, comprising:

a plug screw;

a water intake pipe embedded in the plug screw along with a central axis of the plug screw for inputting a high-pressure liquid;

a flow splitter disposed on an end of the water intake pipe, having multiple through slots for splitting the high-pressure liquid, wherein the multiple through slots are radially defined from a center of the flow splitter to a periphery of the flow splitter so that each of the multiple through slots is perpendicular to the water intake pipe;

a flow baffle disposed in contact with the flow splitter for baffling the high-pressure liquid, wherein the flow baffle has multiple protrusions and recesses defined on a periphery of the flow baffle;

a pillar disposed against the flow baffle;

a heat receiver having a cavity defined inside, wherein a part of the water intake pipe, the flow splitter, the flow baffle and the pillar are disposed in the cavity and the plug screw is connected to the heat receiver through threads such that the plug screw exerts a pre-tension force on the flow splitter and the flow baffle, outer edges of the protrusions of the flow baffle are against an inner wall of the heat receiver, and a micro-channel is defined between the pillar and the heat receiver, and the high-pressure liquid input from the water intake pipe is split into the multiple through slots of the flow splitter, the split high-pressure liquid output from the multiple through slots of the flow splitter passes through the recesses of the flow baffle and enters into the micro-channel, wherein a flow path of the high-pressure liquid in each of the multiple through slots is perpendicular to that in the water intake pipe; and a heat source surrounding the heat receiver for heating the cavity, so that the high-pressure liquid entered into the micro-channel is heated by the heat source to be high-temperature saturated water.

2. The saturated water explosive device according to claim 1, wherein the micro-channel includes a gap defined between an outer surface of the pillar and an inner surface of the heat receiver, and a width of the gap is less than 1 mm.

3. The saturated water explosive device according to claim 1, wherein the micro-channel includes multiple slots defined on an outer surface of the pillar along a length of the pillar, and a width of each slot is less than 1 mm and a depth thereof is less than 1 mm.

4. The saturated water explosive device according to claim 1, wherein the micro-channel includes both a gap defined between an outer surface of the pillar and an inner surface of the heat receiver and slots defined on the outer surface of the pillar along a length of the pillar.

5. The saturated water explosive device according to claim 1, further comprising a porous material disposed in the cavity.

6. The saturated water explosive device according to claim 5, wherein the high-temperature saturated water is ejected from the micro-channel under a high pressure to form saturated water particles which hit against the porous material at a high temperature to incur water explosion, and high-temperature high-pressure steam is produced through rapid and intense vaporization.

7. The saturated water explosive device according to claim 6, wherein the porous material has a mesh structure.

8. The saturated water explosive device according to claim 6, wherein one side of the porous material is a saturated water inlet, and the other side is a steam outlet.

9. The saturated water explosive device according to claim 6, wherein the porous material is for increasing a heating area of the saturated water.

10. The saturated water explosive device according to claim 1, wherein a heat conductor is embedded in the pillar, so that the heat energy can be immediately replenished after the temperature of the pillar decreases.

11. The saturated water explosive device according to claim 1, wherein a heat conductor is independently located outside the pillar.

* * * * *